US009157672B2

(12) United States Patent
Liu et al.

(10) Patent No.: US 9,157,672 B2
(45) Date of Patent: Oct. 13, 2015

(54) DEVICE FOR CONTROLLING A FIXED-CAPACITY COMPRESSOR

(75) Inventors: Jin-Ming Liu, Conflans St. Honorine (FR); Regine Haller, Boissy Sans Avoir (FR); Stefan Karl, Bazemont (FR); Eng Kuach, Montrouge (FR)

(73) Assignee: VALEO SYSTEMES THERMIQUES, Le Mesnil Saint Denis, Cedex (FR)

( * ) Notice: Subject to any disclaimer, the term of this patent is extended or adjusted under 35 U.S.C. 154(b) by 958 days.

(21) Appl. No.: 12/505,107

(22) Filed: Jul. 17, 2009

(65) Prior Publication Data

US 2010/0017038 A1 Jan. 21, 2010

(30) Foreign Application Priority Data

Jul. 18, 2008 (FR) ..... 08 04083

(51) Int. Cl.
*F25B 49/02* (2006.01)

(52) U.S. Cl.
CPC ..... *F25B 49/022* (2013.01); *F25B 2309/061* (2013.01); *F25B 2600/0251* (2013.01); *F25B 2700/197* (2013.01); *F25B 2700/21172* (2013.01); *F25B 2700/21173* (2013.01)

(58) Field of Classification Search
CPC ..... F25B 49/022; F25B 2700/21172; F25B 2700/21173
USPC ..... 62/228.1, 228.3, 229, 239, 244
See application file for complete search history.

(56) References Cited

U.S. PATENT DOCUMENTS 5,259,198 A * 11/1993 Viegas et al. ..... 62/7
5,878,806 A * 3/1999 Denk et al. ..... 165/42
5,924,296 A * 7/1999 Takano et al. ..... 62/133
6,330,909 B1 12/2001 Takahashi et al.
6,895,769 B2 * 5/2005 Okawara et al. ..... 62/228.3
2001/0049943 A1 12/2001 Nakamura et al.
2007/0256436 A1 11/2007 Hayashi
2008/0022704 A1 1/2008 Fukuta
2009/0120113 A1 * 5/2009 Takegami et al. ..... 62/228.3
2009/0217685 A1 * 9/2009 Mola et al. ..... 62/157

FOREIGN PATENT DOCUMENTS

EP 0232188 A2 8/1987
EP 1544556 A1 6/2005
EP 1702667 A2 9/2006
EP 1717527 A1 11/2006

OTHER PUBLICATIONS

INPI Institut National De La Propriet Industrielle Search Report for FA713670/FR0804083, dated Feb. 26, 2009, 1 page.

* cited by examiner

*Primary Examiner* — Jonathan Bradford

(74) *Attorney, Agent, or Firm* — Howard & Howard Attorneys PLLC

(57) ABSTRACT

A command device (13) includes a sensor (15,16) for the measurement of a measured value VM of a characteristic C of a fluid FR,A and a comparison (14) of the measured value VM of the characteristic C of the fluid FR,A with at least two step-values VSmin, VSmax of the characteristic C. The command device (13) includes an upstream temperature sensor (20) to be positioned upstream the evaporator (12) according to the air flow direction (6) to measure an upstream temperature T2 of the air flow (3) and give an information (18) which is taken into account by the command device (13) in order to determine the step-values VSmin, VSmax of the characteristic C.

11 Claims, 3 Drawing Sheets

DEVICE FOR CONTROLLING A FIXED-CAPACITY COMPRESSOR

RELATED APPLICATIONS

This application claims priority to and all the advantages of French Patent Application No. FR 08/04083, filed on Jul. 18, 2008.

TECHNICAL FIELD OF THE INVENTION

The present invention relates to the field of motor vehicle heating, ventilation and/or air conditioning units. The subject of the present invention is a device for controlling the starting of a fixed-capacity compressor. Another subject of the invention is an air conditioning loop comprising such a compressor. A final subject of the invention is a heating, ventilation and/or air conditioning unit comprising such a loop and a method of implementing said device.

PRIOR ART

A motor vehicle is commonly fitted with a heating, ventilation and/or air conditioning unit to modify the aerothermal parameters of the air contained inside the vehicle interior. A unit such as this comprises an air conditioning loop in which there circulates a refrigerant, such as a subcritical fluid, notably, R134a or the like, or such as a supercritical fluid, notably R744 or the like. The air conditioning loop comprises at least a compressor, a condenser or a gas chiller, an expansion member and an evaporator. The air conditioning loop also potentially comprises an internal heat exchanger. An airflow passes through the evaporator where it is cooled prior to being delivered into the vehicle interior.

The compressor is a fixed-capacity compressor for which the swept volume is constant. Control means control the starting of the compressor on the basis of a measurement of the temperature of the airflow leaving the evaporator and of a comparison of said measured temperature with two setpoint temperatures. More specifically, the compressor is started when the temperature of the airflow measured at the outlet from the evaporator is higher than a first setpoint temperature and the compressor is stopped when the temperature of the airflow measured at the outlet from the evaporator is lower than a second setpoint temperature, the latter being lower than the first setpoint temperature.

A general problem presented by such a unit lies in the fact that the starting of the compressor and, conversely, its stopping, are governed by said setpoint temperatures which are fixed and independent of any variations in the conditions of use of said loop. Now, under certain circumstances, it may be desirable to make the procedures for starting and/or stopping the compressor more flexible, notably with a view to rapidly improving the thermal comfort desired by the user of the vehicle, and/or to making energy savings by using the compressor only when such use is needed.

SUBJECT OF THE INVENTION

It is an object of the present invention to propose a device for controlling the starting of a fixed-capacity compressor which is simple and inexpensive to produce, is robust, compact, and can be readily incorporated into a motor vehicle heating, ventilation and/or air conditioning unit, such a device making it possible to make a saving on the energy needed to run the compressor. It is another object of the present invention to propose an air conditioning loop equipped with such a device, said loop offering thermal comfort that can be rapidly optimized with respect to a thermal condition of the air contained inside the vehicle interior. It is another object of the present invention to propose a vehicle heating, ventilation and/or air conditioning unit which comprises such a loop and which is simple and inexpensive to implement, said unit having a low power consumption. It is a final object of the present invention to propose a method of using such an air conditioning loop that is easy to implement.

The control device of the present invention is a control device for controlling a fixed-capacity compressor associated with an evaporator through which an airflow passes in a direction of flow of the airflow. Said compressor and said evaporator constitute an air conditioning loop of a motor vehicle heating, ventilation and/or air conditioning unit. Said device comprises a gage intended to measure a measured value VM of a characteristic C of a fluid FR, A and comparison means for comparing the measured value VM of the characteristic C of the fluid FR, A with at least two threshold values VSmin, VSmax of said characteristic C.

According to the present invention, said device comprises an upstream temperature gage intended to be positioned upstream of said evaporator in said direction of flow in order to measure an upstream temperature T2 of the airflow and deliver an information item which is taken into consideration by said device in order to determine the threshold values VSmin, VSmax of said characteristic C.

These arrangements are such that the threshold values VSmin, VSmax are determined from an information item relating to the upstream temperature T2 of said airflow measured upstream of the evaporator and are able to vary as a function of said information item. It then follows that the threshold values VSmin, VSmax are determined as a function of the nature of a thermal load on the evaporator.

Said device is advantageously a standalone device equipped with means of connection to a source of electrical power to operate the gage that measures said measured value VM and the upstream temperature gage.

These arrangements are such that said device is independent of any other control device, giving it the advantage that it can be installed at a relatively arbitrary point in said unit. More specifically, the device can be held inside an elementary housing which can easily be attached to a housing that makes up said unit and inside which housing the airflow circulates.

The comparison means preferably consist of an operational amplifier.

The comparison means are preferably associated with determining means for determining the two threshold values VSmin, VSmax of said characteristic C from the information item relating to the upstream temperature T2 of the airflow.

An air conditioning loop of a motor vehicle heating, ventilation and/or air conditioning unit according to the present invention is chiefly discernible in that said loop comprises such a control device.

The fluid FR, A consists, for example, of air A forming the airflow, the characteristic C consisting of a downstream temperature T1 of the airflow measured downstream of the evaporator in the direction of flow of the airflow through the latter, and in that the threshold values VSmin, VSmax consist of respective minimum T1min and maximum T1max values of said downstream temperature T1.

The fluid FR, A consists, again for example, of a refrigerant FR circulating in said loop, the characteristic C consisting of a pressure P of said refrigerant FR inside the evaporator, and in that the threshold values VSmin, VSmax consist of respective minimum Pmin and maximum Pmax values of said pressure P.

A heating, ventilation and/or air conditioning unit of the present invention is chiefly discernable in that said unit comprises such an air conditioning loop.

Said unit notably comprises an inlet flap for letting the airflow into a housing that forms part of the unit.

The upstream temperature gage is, for example, positioned downstream of said flap in the direction of flow of the airflow in said unit.

The upstream temperature gage is, again for example, positioned upstream of said flap in the direction of flow of the airflow in said unit.

A method according to the present invention of implementing a control device such as this is characterized in that said method comprises a step of determining said threshold values VSmin, VSmax as a function of said information item relating to the upstream temperature T2 of the airflow taken upstream of the evaporator.

Said determining step is advantageously followed:

by a step of starting the compressor, if the measured value VM of the characteristic C is higher than the maximum threshold value Vmax, or by a step of stopping the compressor if the measured value VM of the characteristic C is lower than the minimum threshold value Vmin.

DESCRIPTION OF THE FIGURES

The present invention will be better understood, and resulting details thereof will emerge, from reading the description which is about to be given of some alternative forms of embodiment, in conjunction with the figures of the attached plates, in which:

In FIG. 1, a motor vehicle is fitted with a heating, ventilation and/or air conditioning unit 1 to modify the aerothermal parameters of the air contained inside the vehicle interior. In general terms, the unit 1 comprises a housing 2 in which an airflow 3 circulates before it is delivered into the vehicle interior. More specifically, the housing 2 is equipped with an air inlet 4 through which the airflow 3 is admitted into the housing 2 and an air outlet 5 through which the airflow 3 is delivered into the vehicle interior. The airflow 3 flows inside the housing 2 from the air inlet 4 to the air outlet 5 in the direction 6 of flow of the airflow 3. The air inlet 4 is provided with an air inlet flap 7. The latter 7 can be moved between an open position in which it allows air to be admitted into the housing 2 and a closed position in which it prevents such admission.

Figure 1:
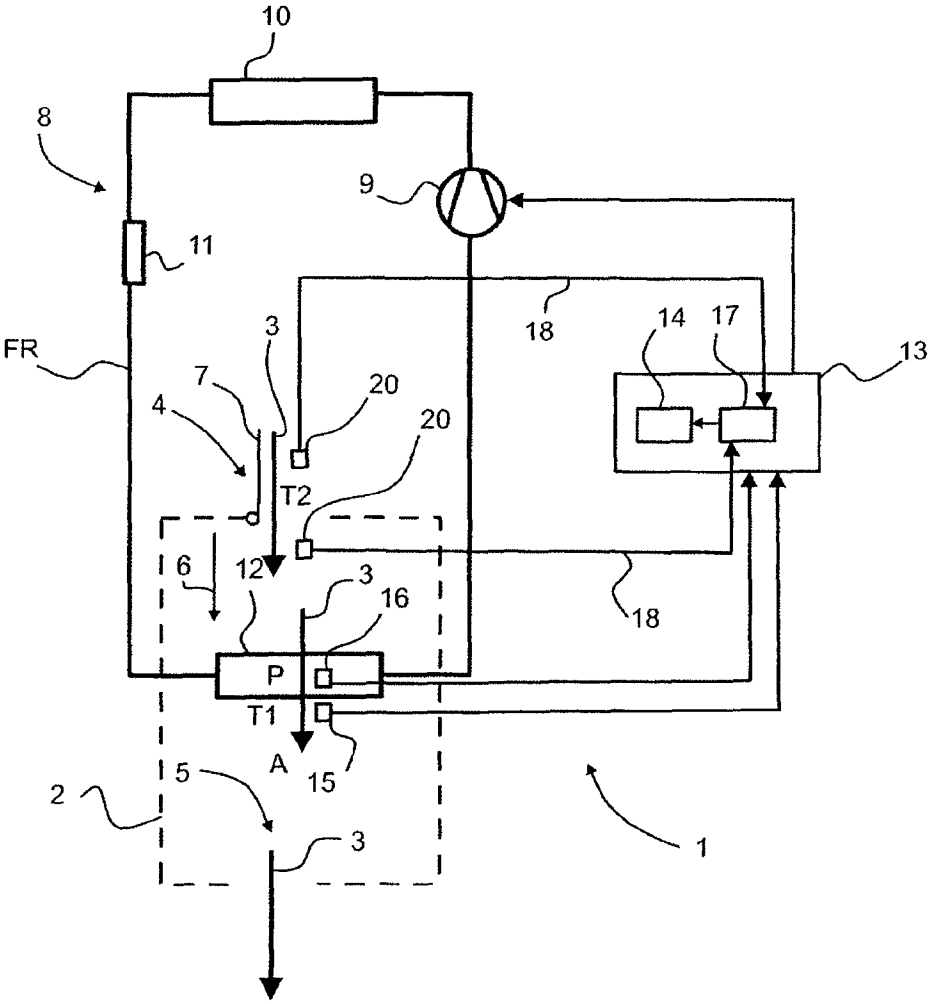
FIG. 1 is a schematic illustration of a heating, ventilation and/or air conditioning unit comprising an air conditioning loop according to the present invention.

To modify the temperature of the airflow 3 before delivering it into the vehicle interior, said unit 1 comprises an air conditioning loop 8 in which a refrigerant FR, which with equal preference could be subcritical or supercritical, circulates. The air conditioning loop 8 comprises a compressor 9 to compress the refrigerant, a condenser 10 or a gas chiller 10 in which the refrigerant gives up heat to its environment, an expansion member 11 in which the refrigerant undergoes expansion, and an evaporator 12 to cool said airflow 3 which passes through the latter 12. The air conditioning loop can also comprise an internal heat exchanger, not depicted in FIG. 1, which more particularly delineates an air conditioning loop 8 in which a subcritical refrigerant FR circulates. Inside an air conditioning loop 8 such as this, the refrigerant FR circulates from the compressor 9 to the condenser 10, then to the expansion member 11, then to the evaporator 12 in order finally to return to the compressor 9. However, the present invention also applies to an air conditioning loop 8 in which a supercritical refrigerant FR circulates.

Figure 2:
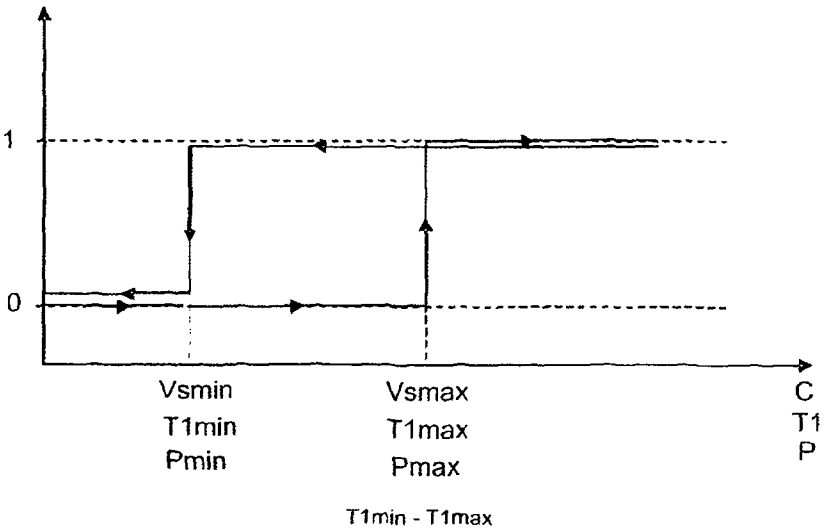
FIG. 2 is a schematic illustration of a method of using the air conditioning loop depicted in the previous figure.

The compressor 9 is a fixed-capacity compressor for which the swept volume is constant. The compressor 9 is equipped with a control device 13 to determine the starting and/or stopping of the compressor 9. To this end, and with reference also to FIG. 2, the control device comprises comparison means 14 for comparing a measured value VM of a characteristic C of a fluid FR, A against two threshold values VSmin, VSmax of the characteristic C of the fluid FR, A. Said threshold values VSmin, VSmax are, respectively, a minimum threshold value VSmin of the characteristic C of the fluid FR, A and a maximum threshold value VSmax of the characteristic of the fluid FR, A, the latter, VSmax, being higher than the minimum threshold value VSmin. The compressor 9 is switched on when the measured value VM of said characteristic C is higher than said maximum threshold value VSmax. The compressor 9 is switched off when the measured value VM of said characteristic C is lower than said minimum threshold value VSmin.

According to a first alternative form of embodiment, said fluid FR, A consists of air A forming the airflow 3 that passes through the evaporator 12, said characteristic C consisting of a downstream temperature T1 of the airflow 3 measured downstream of the evaporator 12 in the direction of flow 6 of the airflow 3 through the evaporator 12, and the two threshold values VSmin, VSmax consist of a minimum downstream temperature T1min and of a maximum downstream temperature T1max of the airflow 3. In this case, said downstream temperature T1 is measured by a downstream temperature gage 15, such as a negative temperature coefficient resistive element commonly known by its English-language acronym "CTN" or such as a thermomechanical instrumentation device.

According to a second alternative form of embodiment, said fluid FR, A consists of the refrigerant FR which circulates in the air conditioning loop 8, said characteristic C consisting of a pressure P of the refrigerant FR measured inside the evaporator 12, and the two threshold values VSmin, VSmax consist of a minimum pressure Pmin and of a maximum pressure Pmax of the refrigerant FR. In this case, the pressure P of the refrigerant is measured either via a pressure gage 16 such as a transducer, or via a pressure switch.

According to the known art, the threshold values VSmin, VSmax are fixed and remain constant irrespective of the conditions of use of the air conditioning loop 8, notably irrespective of the nature of a thermal load on the evaporator 12.

To address this disadvantage, notably with a view to saving on the energy needed to implement the compressor 9, the present invention proposes for the control means 13 to comprise determining means 17 able to cause the threshold values VSmin, VSmax to vary as a function of an information item 18 received via the determining means 17.

Said information item 18 is an information item relating to an upstream temperature T2 of the airflow 3, measured upstream of the evaporator 12 in the direction of flow 6 of the airflow 3 through the evaporator 12. Said upstream temperature T2 is measured by an upstream temperature gage 20, such as a negative temperature coefficient "CTN" resistive element. According to a first embodiment option, the upstream temperature gage 20 is positioned downstream of said air inlet flap 7 whereas according to a second embodiment option, the upstream temperature gage 20 is positioned upstream of said air inlet flap 7. The latter option has the advantage of offering the possibility of using, by way of upstream temperature gage 20, an external temperature gage with which the motor vehicle is commonly fitted, thus adding no additional cost.

This first embodiment for example proposes the following values of T1max and T1 min as a function of said information item 18 relating to the upstream temperature T2 of the airflow 3 measured upstream of the evaporator 12:

| | T2 | | | | |
|---|---|---|---|---|---|
| | >30° C. | 25° C. | 20° C. | 15° C. | <10° C. |
| T1max | 5° C. | 7° C. | 9° C. | 11° C. | 5° C. |
| T1min | 2° C. | 4° C. | 6° C. | 8° C. | 2° C. |

In this example, it is notable that the values T1max and T1min satisfy the relationship R:

$$T1\max - T1\min = 3°\ C. \quad (R)$$

Figure 3:
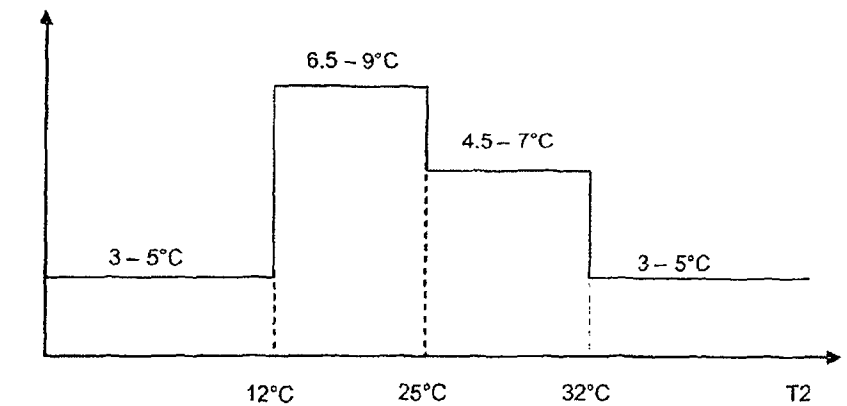
FIG. 3 is a schematic illustration of the result of implementing the method illustrated in the previous figure.

FIG. 3 illustrates the result of implementing such an air conditioning loop 8 according to the method of the present invention, in which various values of T1max and of T1min are obtained as a function of the measured value of the upstream temperature T2 of the airflow 3, measured upstream of the evaporator 12.

Figure 4:
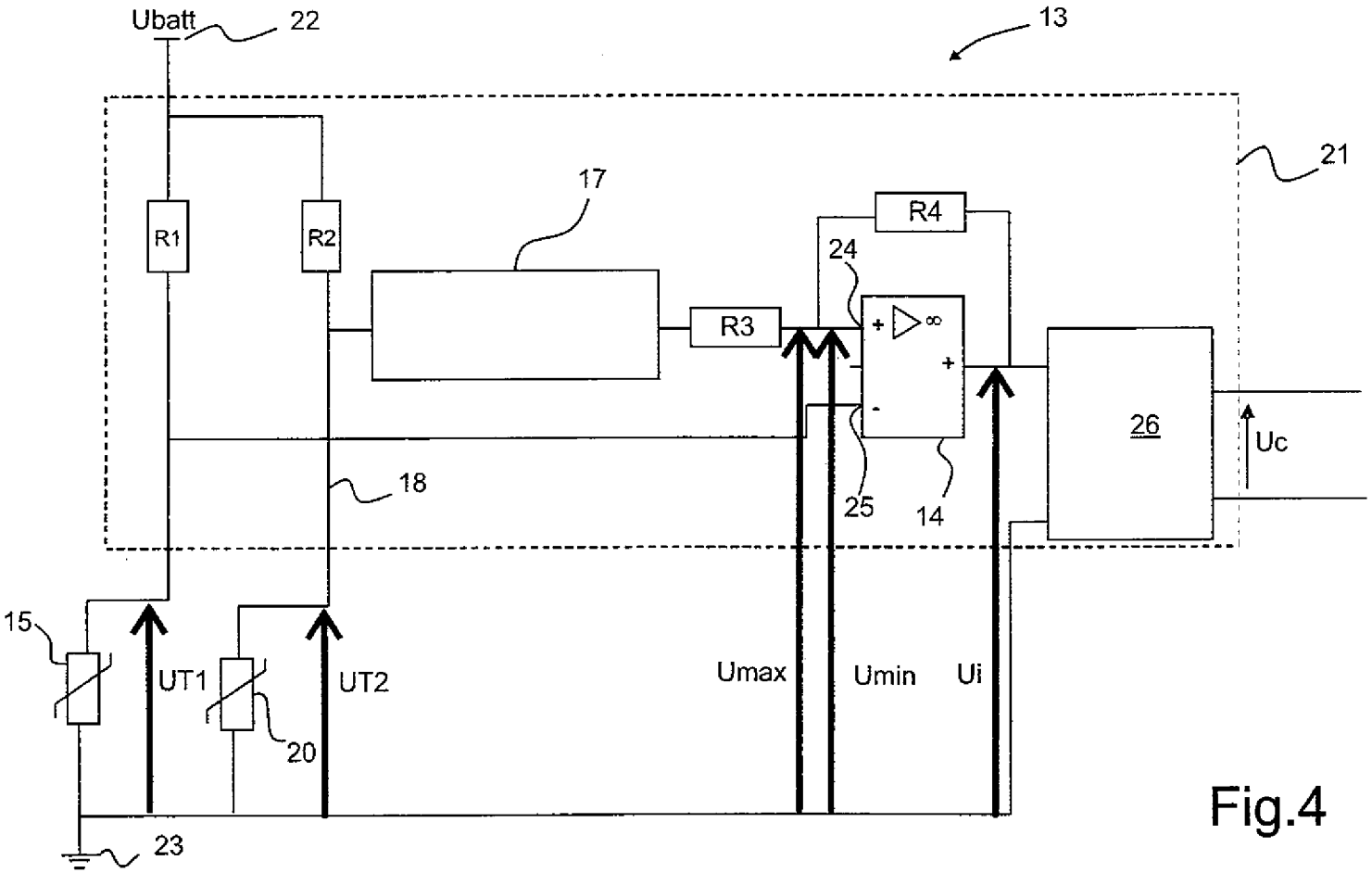
FIG. 4 is a schematic illustration of an alternative form of embodiment of means of controlling a compressor involved in the air conditioning loop depicted in FIG. 1.

FIG. 4 depicts one advantageous embodiment of said control device 13. The designers who conceived the present invention have chosen to propose a simple and inexpensive embodiment of the control device 13. The latter 13 is notably able to be housed inside an elementary housing 21 that can be installed at a relatively arbitrary point in said unit 1. The control device 13 proposed by the present invention is a standalone device independent of other instrumentation and/or control means, that said unit may comprise. This results in great convenience of use and installation of the control device 13 which is therefore free of any disturbance and malfunction caused by other instrumentation and/or control means. This independence and this simplicity gives the control device 13 a distinct advantage over other existing control devices which are more complex, incorporate numerous functionalities, and are liable to suffer from malfunctions.

The downstream temperature gage 15 and the upstream temperature gage 20 are interposed between a battery terminal 22 and a ground terminal 23 of an electrical power source. A potential difference Ubatt is applied between the battery terminal 22 and the ground terminal 23. A first resistor R1 is interposed between the downstream temperature gage 15 and the battery terminal 22, while a resistor R2 is interposed between the upstream temperature gage 20 and the battery terminal 22. The upstream temperature gage 20 is able to deliver an upstream voltage UT2 which is transmitted to the determining means 17 to adapt the threshold values VSmin, VSmax, which in this example consist respectively of the minimum downstream temperature T1min and of the maximum downstream temperature T1max of the airflow 3.

The determining means 17 transmit, through a third resistor R3, to a first input terminal 24 of an operational amplifier 14 the reference voltage values Umin and Umax that correspond respectively to the threshold values VSmin and VSmax. Via a second input terminal 25 of the operational amplifier 14, the latter receives a voltage Um corresponding to said measured value VM in order to compare the voltage Um to the voltages Umin and Umax and to provide an instruction voltage Ui to a control interface 26 of the compressor 9. The interface is able to deliver a compressor voltage Uc which determines whether the compressor 9 is started or stopped.

Such a control device 13 has the simplest possible structure giving it optimized reliability and robustness for reliable and durable control of the starting and/or stopping of the compressor 9, on the basis of the information item 18 relating to an upstream temperature T2 of the airflow 3 measured upstream of the evaporator 12, said information item 18 being representative of a thermal load on the evaporator 12, such that the thermal comfort afforded by said unit 1 is consistent with the actual, precise, and repeatedly updated nature of the aerothermal parameters of the airflow 3 and/or of parameters relating to the refrigerant FR and/or the operating conditions of the evaporator 12.

The invention claimed is:

1. A control device (13) for controlling a fixed-capacity compressor (9) associated with an evaporator (12) through which an airflow (3) passes in a direction of flow (6) of the airflow (3), said compressor (9) and said evaporator (12) constituting an air-conditioning loop (8) of a motor vehicle heating, ventilation and/or air conditioning unit (1), wherein said unit (1) includes a housing (2) having an inlet flap (7) configured to allow air to be admitted into said housing (2) in an open position and to prevent air from being admitted into said housing (2) in a closed position, said device (13) comprising a temperature gage (15, 16) disposed within said housing (2) and positioned downstream of said evaporator (12) intended to measure a measured value VM of a characteristic C of a fluid FR, A and comparison means (14) for comparing the measured value VM of the characteristic C of the fluid FR, A with at least two threshold values VSmin, VSmax of the characteristic C, characterized in that said device (13) comprises an upstream temperature gage (20) disposed within said housing (2) and positioned upstream of said evaporator (12) and downstream of said inlet flap (7) in said direction of flow (6) in order to measure an upstream temperature T2 of the airflow (3) and deliver an information item (18) corresponding to the upstream temperature T2, which is taken into consideration by said device (13) in order to determine the threshold values VSmin, VSmax of the characteristic C, said device (13) including determining means (17) to cause the threshold values VSmin, VSmax to vary as a function of an information item (18) received via the determining means (17).

2. A control device (13) according to claim 1, characterized in that said device (13) is a standalone device connected to a source of electrical power to operate said gage (15, 16) that measures the measured value VM and said upstream temperature gage (20).

3. A control device (13) according to claim 1, characterized in that said comparison means (14) comprises an operational amplifier.

4. An air conditioning loop (8) of a motor vehicle heating, ventilation and/or air conditioning unit (1), characterized in that said loop (8) comprises a control device (13) according to claim 1.

5. An air conditioning loop (8) according to claim 4, characterized in that the fluid FR, A comprises air A forming the airflow (3), the characteristic C comprising a downstream temperature T1 of the airflow (3) measured downstream of said evaporator (12) in the direction of flow (6) of the airflow (3) through the latter (12), and in that the threshold values VSmin, VSmax comprise respective minimum T1min and maximum T1max values of the downstream temperature T1.

6. An air conditioning loop (8) according to claim 4, characterized in that the fluid FR, A comprises a refrigerant FR circulating in said loop (8), the characteristic C comprising a pressure P of said refrigerant (FR) inside said evaporator (12), and in that the threshold values VSmin, VSmax comprise respective minimum Pmin and maximum Pmax values of the pressure P.

7. A heating, ventilation and/or air conditioning unit (1) comprising an air conditioning loop (8) according to claim 4.

8. A method of implementing a control device (13) according to claim 1, comprising a step of determining the threshold values VSmin, VSmax as a function of the information item (18) relating to the upstream temperature T2 of the airflow (3) taken upstream of the evaporator (12).

9. A method according to claim 8, characterized in that said determining step is followed:

by a step of starting the compressor (9), if the measured value VM of the characteristic C is higher than the maximum threshold value Vmax, or by a step of stopping the compressor (9) if the measured value VM of the characteristic C is lower than the minimum threshold value Vmin.

10. A control device (13) according to claim 1, wherein the threshold values VSmin, VSmax vary as a function of the information item (18) relating to the upstream temperature T2.

11. A control device (13) according to claim 1, wherein the information item (18) represents a thermal load on said evaporator (12).

* * * * *